United States Patent [19]

Krupicka et al.

[11] Patent Number: 4,598,939

[45] Date of Patent: Jul. 8, 1986

[54] EXIT DEVICE

[75] Inventors: William A. Krupicka; Lawrence D. Butts, both of Charlotte; Sidney J. Lampley, Monroe, all of N.C.

[73] Assignee: Scovill Inc., Waterbury, Conn.

[21] Appl. No.: 618,688

[22] Filed: Jun. 8, 1984

[51] Int. Cl.[4] ..... E05C 15/02

[52] U.S. Cl. ..... 292/92; 292/210; 292/222; 292/DIG. 66

[58] Field of Search ..... 292/222–224, 292/92, 210, DIG. 66, 169.13, 169.14, 227; 49/8, 7; 70/92

[56] References Cited

U.S. PATENT DOCUMENTS

| | | | |
|---|---|---|---|
| 3,337,250 | 8/1967 | Russell et al. | 292/210 |
| 3,345,099 | 10/1967 | Paul et al. | 292/224 X |
| 3,359,027 | 12/1967 | Schlage et al. | 292/222 |
| 3,705,739 | 12/1972 | Adler | 292/92 |
| 3,877,262 | 4/1975 | Williams | 292/92 X |
| 4,183,565 | 1/1980 | Allemann | 292/DIG. 66 X |

FOREIGN PATENT DOCUMENTS

| | | | |
|---|---|---|---|
| 1549636 | 8/1979 | United Kingdom | 292/DIG. 66 |

*Primary Examiner*—Robert L. Wolfe
*Assistant Examiner*—Russell W. Illich
*Attorney, Agent, or Firm*—Dallett Hoopes

[57] ABSTRACT

Exit device has auxiliary bolt which when held in by door strike permits a blocking leg to prevent unauthorized forced retraction of main latch bolt. Normal operation of device by panic bar pivots blocking leg out of the way and then retracts main latch bolt.

6 Claims, 10 Drawing Figures

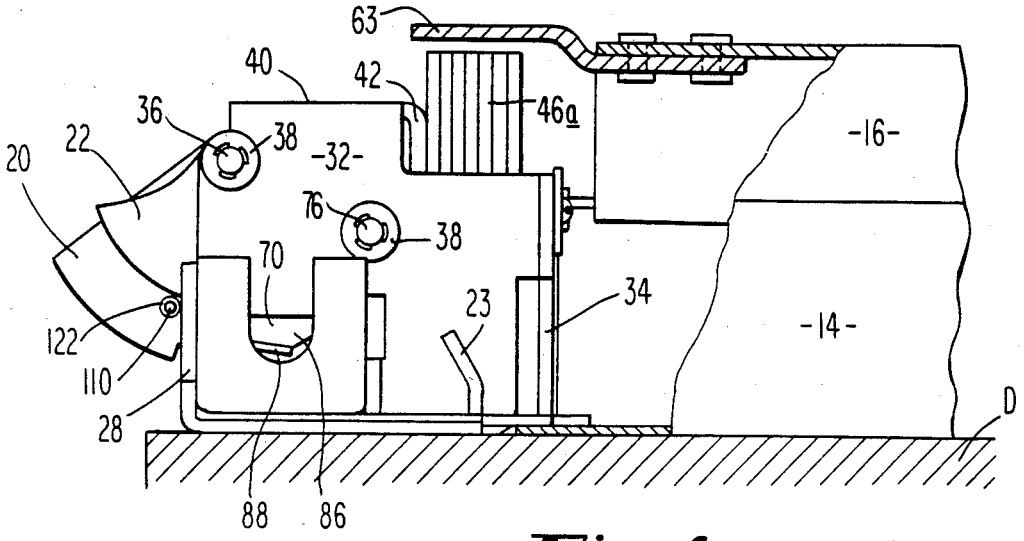
Fig. 4
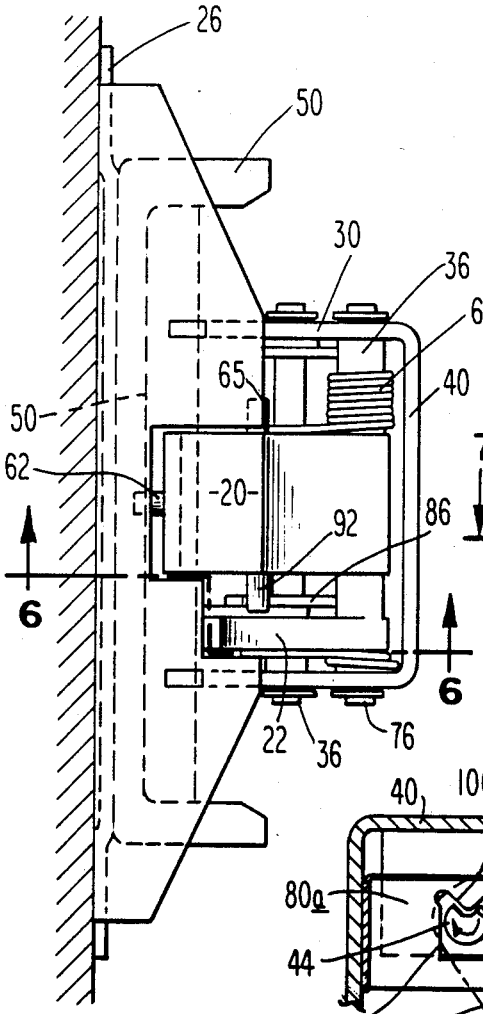
Fig. 5
Fig. 6
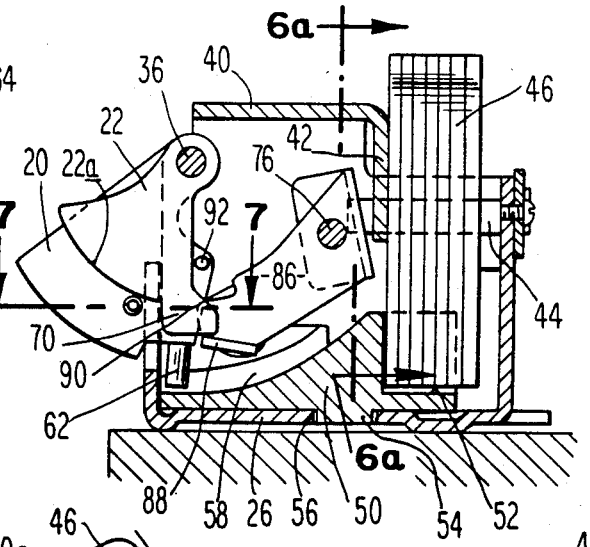
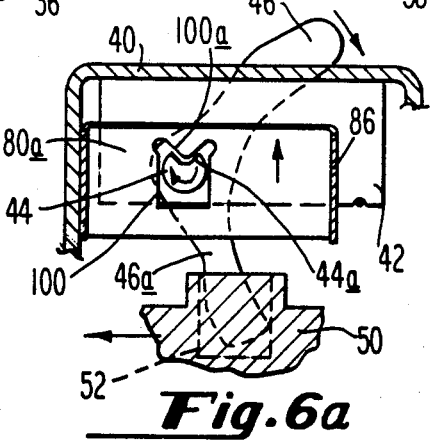
Fig. 6a
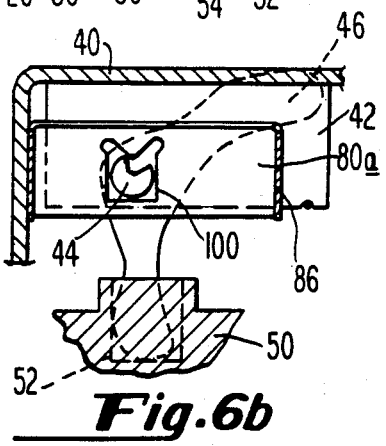
Fig. 6b

EXIT DEVICE

BACKGROUND OF THE INVENTION

1. Field of the Invention

This invention relates in general to an exit device including a latch and actuator assembly and deals more particularly with an improved dead latch arrangement and actuator assembly of the rim or surface-mounted type.

2. Description of the Prior Art

Exit devices or panic bolts of the afore-described type are generally known in the art. An example is disclosed in the active U.S. Pat. No. 3,877,262 which issued Apr. 15, 1975 to Merton S. Williams. In some of the earlier exit devices, dead latches have been provided usually with the addition of a number of parts which have been required to assure their efficacy. These prior devices have been subject to breakdown, and have been expensive to manufacture and maintain.

SUMMARY OF THE INVENTION

Under the present invention the exit device features a latch bolt which includes an operating pin which can be cammed into retracted position by the movement of a cam-bearing vertical slide driven by a lever actuated by the panic bar of the device. The invention additionally includes an auxiliary bolt pivoted in the housing and adapted on being depressed by engagement with the door strike to permit a blocking leg to raise into position to block the retraction of the latch bolt. Subsequent normal operation of the latch by the panic bar or other operator instantly cams the blocking leg out of the way of the latch bolt and then retracts the latch bolt.

BRIEF DESCRIPTION OF THE DRAWINGS

Other objects and features of the invention will be apparent from a reading of the specification and an inspection of the accompanying drawings in all of which is disclosed a non-limiting embodiment of the invention.

In the drawings:

FIG. 4 is a bottom fragmentary plan view of the latch and actuator assembly with the housing partly broken away;

FIG. 5 is a front end view;

FIG. 6 is a view taken on the line 6—6 of FIG. 5;

FIG. 6*a* is a fragmentary sectional view taken on the line 6*a*—6*a* of FIG. 6 but showing the U-shaped element as it appears with the auxiliary bolt held in by the strike;

FIG. 6*b* is a view similar to FIG. 6*a* but showing the U-shaped element after the panic bar has been pressed down;

DESCRIPTION OF THE PREFERRED EMBODIMENT

Figure 1:
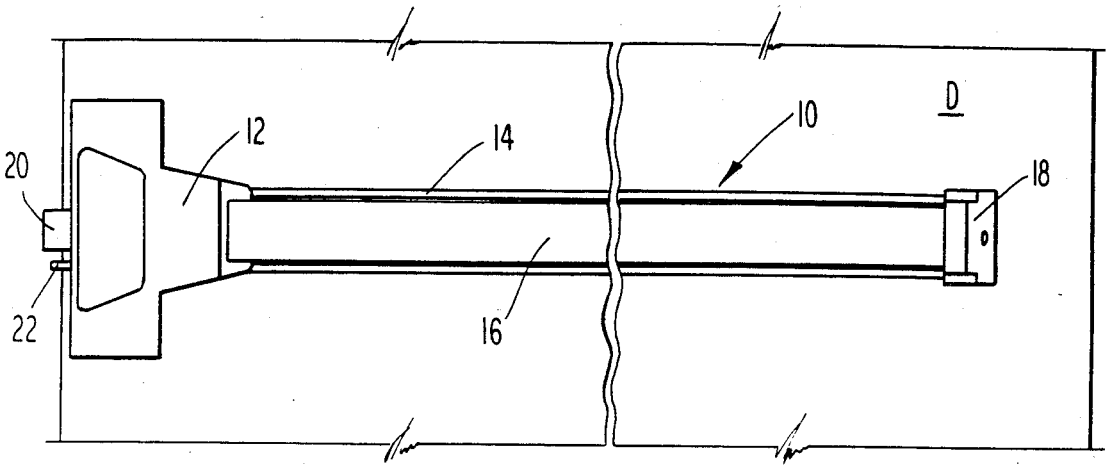
FIG. 1 is a front plan view of an exit device mounted on a door and embodying the invention.

An exit device embodying the invention is generally designated 10 in FIG. 1 and mounted on the door D. Shown in FIG. 1 is a latch actuator housing cover 12 and an elongate bar skirt 14 in which is mounted for depression the flat panic bar 16. A cosmetic end cover 18 hides the end of the skirt and panic bar 16. Extending outward from the cover 12 is the latch bolt 20 and the familiar pivoted auxiliary bolt 22.

Figure 2:
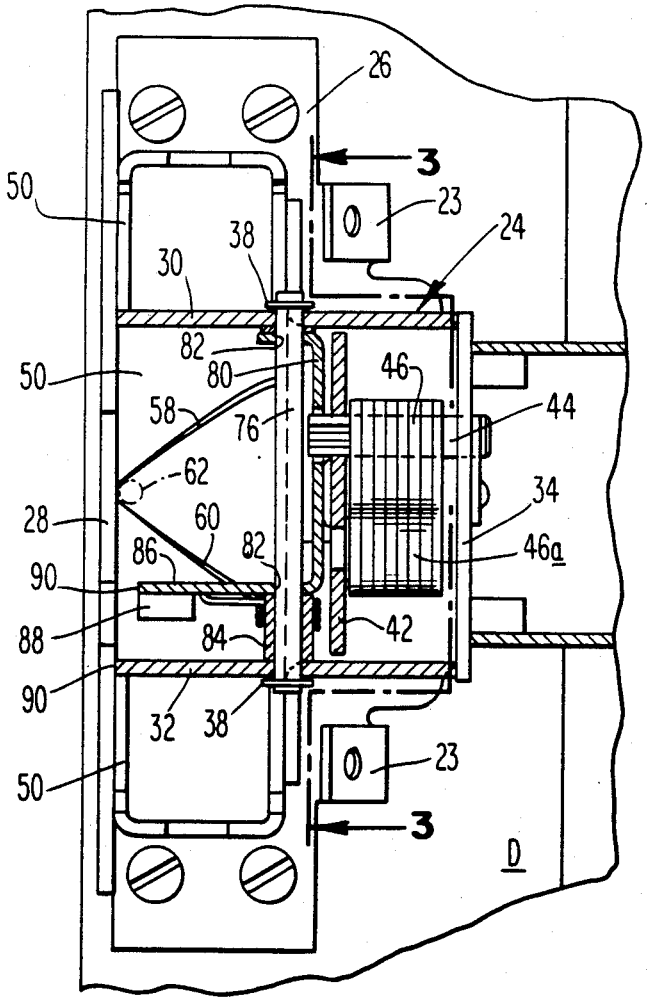
FIG. 2 is an enlarged fragmentary view of the latch and actuator assembly with the cover and panic bar removed and taken on line 2—2 of FIG. 3.

With the cover 12 removed from its mounting clips 23 as shown in FIG. 2 there is exposed a housing 24 for the latch and actuator. The box-like housing comprises a base member 26 having an upstanding front panel 28, side panels 30 and 32, and rear panel 34. A latch bolt spindle 36 (FIG. 4) is disposed in aligned openings in side panels 30 and 32. The ends of the spindle protrude through the side panels and are fixed in position by press nuts 38 and the latch bolt 20 and auxiliary bolt 22 are journaled thereon to comprise a latch assembly.

Figure 3:
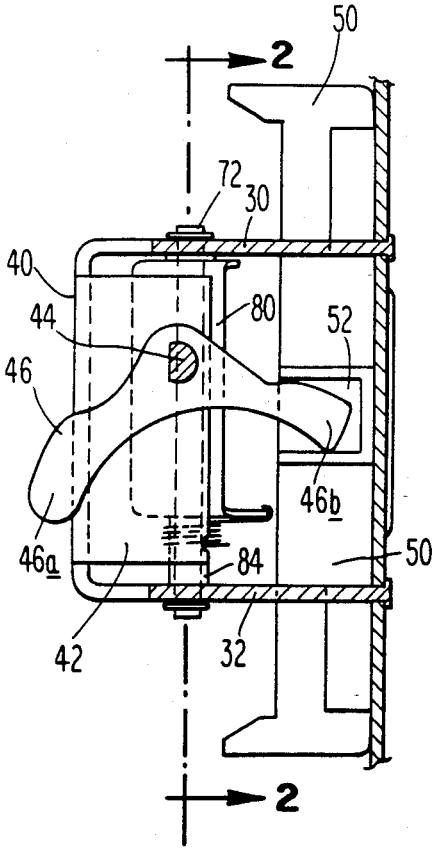
FIG. 3 is a fragmentary sectional view taken on the line 3—3 of FIG. 2 with the latch assembly removed for simplicity.

A cover panel 40 (FIG. 4) joins the side panels 30 and 32 and a depending web 42 is disposed parallel to the rear panel 34. Aligned openings in depending web 42 and rear panel 34 receive the stub shaft 44 comprising the fulcrum of an L-shaped lever 46 (FIG. 3). In the preferred embodiment the lever 46 is in the form of packed-together steel laminants giving the structure great strength and wear resistance.

As shown in FIG. 2 the unit further comprises a slideable vertical yolk element 50 which rests against the base member 26 and includes a rightward extension (FIG. 6), presents a pocket 52 entrapping the lower end of the L-shaped lever 46. The upper and lower ends of the yolk element can engage the conventional upper and lower latch rods for three point latching if desired. As best shown in FIG. 6 the yolk element 50 is formed with a downward rib 54 which is received into a vertical slot 56 in the base plate 26. This arrangement helps guide the yolk as it moves up and down in the housing. The rib 54 may provide an operative connection between the latch and an operator external of the door, such as a thumb piece or lock cylinder lever as is well known in the art.

FIGS. 2 and 6 also show the converging cam surfaces 58 and 60 on the yolk 50 which converge toward a point an equal distance between the ends of the yolk and adjacent the front wall 28 of the housing.

As shown in FIG. 6 the latch bolt 20 is formed with a downward pin 62 which is projected in dotted lines in FIG. 2 at the convergence of the cam surfaces 58 and 60. As a result, when the yolk in FIG. 2 is raised or lowered, the pin 62 is driven inward of the housing by one of the converging surfaces 58 and 60 causing the latch bolt 20 (FIG. 6) to retract. Return of the yolk to its central position shown in FIG. 2 permits the latch bolt to extend as shown in FIG. 6.

The panic bar 16 (FIG. 4) is mounted for reciprocation toward and away from the door by conventional means not shown. It is spring-biased away from the door. FIG. 4 shows the leftward extension plate 63 which is riveted or otherwise secured to the bar 16 and extends over the upward arm 46*a* of the lever 46. Resulting from this structure, when the bar is pressed (FIG. 4) the arm 46*a* of the lever 46 is moved inward of the housing causing the arm 46*b* which extends in pocket 52 of the yolk 50 to move upwardly moving the entire yolk 50. Such movement results in the upward movement of the cam 60 to drive the pin 62 inward, retracting the latch 20, permitting it to clear the strike (not shown) and allowing the door to open.

The axial spring 64 surrounding the spindle 36 (FIG. 5) and at one end engages a pin 65 on the latch bolt 20 and on the other end engages the housing. The spring, therefore, drives the latch bolt to its extended condition when the panic bar 16 is disengaged causing the yolk 50 to return to the position shown in FIG. 2.

The auxiliary bolt 22 is also pivotally mounted on the spindle 36 (FIG. 6) and includes a downward projection 70. The opposite ends of an axial spring 72 engage the housing 24 and the auxiliary bolt 22 respectively to drive the auxiliary bolt in the extended position.

There will now be described an auxiliary latch-operating means which is an important feature of this invention.

A secondary spindle is provided at 76 and is journaled between the sidewalls 30 and 32 of the housing held in place by press nuts 38. A U-shaped bracket 80 is provided with aligned openings in the legs of the "U" as at 82, the openings 82 receiving the spindle 76 and a spacer or bushing 84 keeps the bracket from moving laterally on the spindle. The lower leg 86 of the bracket extends outward and terminates angularly in a follower pad 88 which engages the bottom surface of the auxiliary bolt 22.

As can be readily envisioned, the pad 88 is normally held downward (FIG. 6) by the projection 70 on the auxiliary bolt 22. However, when that auxiliary bolt is retracted as by contact with the door frame strike, the projection 70 moves inward and the pad 88 in the absence of the projection 70 moves upward (FIG. 6) to engage the periphery 22*a* of the auxiliary latch 22. This places the blocking surface 90 clearly in the path of a blocking pin or projection 92 extending outward from the side of the latch bolt 20 blocking any attempt to retract the latch bolt by force directly upon it.

Referring more particularly to the U-shaped bracket 80, its bight 80*a* (FIG. 6*a*) is formed with an irregularly shaped opening 100 the margin of which features a downward U-shaped projection 100*a*. As shown, the stub shaft 44 extends beyond the web 42 and terminates in a shape having a groove 44*a*. This structure results in a raising of the bight 80*a* when the stub shaft 44 is turned by the lever 46. When the movement of the panic bar is initiated, the raising of the bight as shown in FIG. 6*b* results in a lowering of the leg 86 to a position comparable to that shown in FIG. 56 even though with the door closed the auxiliary bolt 22 is held retracted. This downward movement of the leg 86 moves the blocking surface 90 out of the way of the pin 92 to permit the free movement of the latch 20.

It should be understood that the ample lower portion of the opening 100 on the bight 80*a* permits lowering of the wing 86 as the lobe 70 of the auxiliary latch 22 moves to its extended position.

Thus, it should be clear that the lowering of the leg 86 with its surface 90 to permit the free passage of pin 92 and retraction of the main latch bolt 20 may be accomplished either (1) by the lobe 70 of the extended auxiliary latch 22 holding the leg downward through engagement with pad 88 to permit the free retraction of the latch upon hitting the strike as in the normal closing of the door; or (2) by the rotation of the stub shaft 44 (FIG. 6*a*) as the opening of the door by panic bar is initiated.

As stated, the unlatching of the door by panic bar in normal opening is accomplished by the upward movement of the arm 46*b* of lever 46 which moves yoke 50 up causing the surface 60 to drive the pin 62 inward retracting the latch bolt 20. Continued pressing of the panic bar, of course, opens the door.

Figure 7:
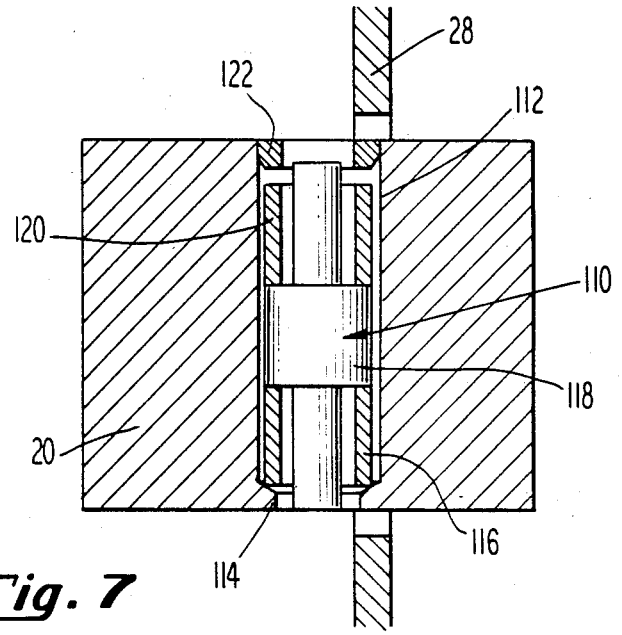
FIG. 7 is a greatly enlarged sectional view taken on the line 7—7 of FIG. 6 showing the safety fire locking feature of the assembly intact.
Figure 8:
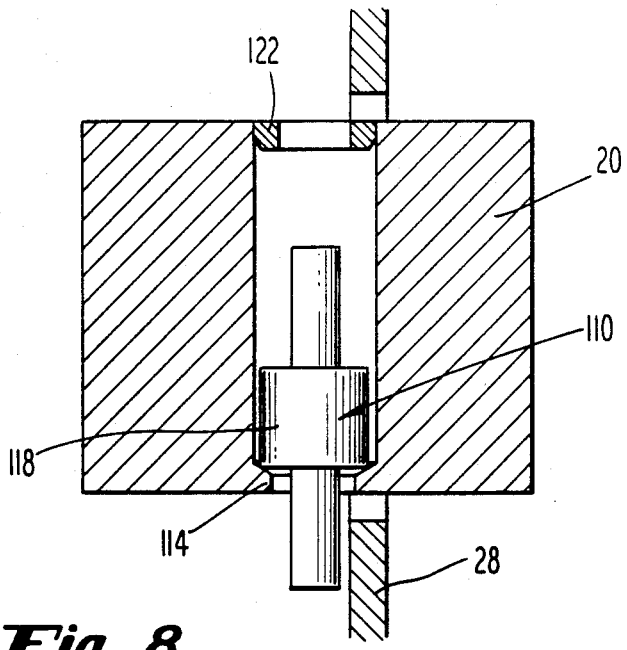
FIG. 8 is a sectional view similar to FIG. 7 showing the assembly after it has been subjected to fusing temperatures as in a fire.

A feature of the latch shown in the accompanying drawings is shown in FIGS. 7 and 8 and comprises a locking pin 110 which is disposed in a bore 112 in the main latch 20. As shown there is an inward shelf 114 at the lower end of the bore and a fusible spool 116 is disposed against the inside of the shelf 114. The pin is formed with a central enlargement 118 which rests on the top of the spool 116. A second fusible spool 120 superposes the enlargement 110 and surrounds the pin and a non-fusible retainer ring 122 is press-fitted into the top of the bore 112. As a result of the structure described, high heat as in the case of a fire, will cause the fusible spool 116 to melt permitting the pin 110 to drop so that its enlargement 118 rests on the inward shelf 114. This causes the lower end of the pin 110 to extend downward and lie on the outside of the front panel 28 blocking the retraction of the latch so that the door cannot be opened accidentally or otherwise to permit the spread of the fire. The purpose of the ring 122 is to duplicate the shelf 114 so that the latch can be inverted for doors of opposite hand.

While this invention has been described in but a single modification, it should be understood that the invention involved is not so limited, but may be defined by the scope of the attached claim language including equivalents thereof.

We claim:

1. An exit device comprising a horizontal panic bar, adapted to be mounted waist-high on a swinging door, a latch housing adapted to be secured outward of the door adjacent an end of the panic bar, the latch housing holding a vertically reciprocable slide having similar but opposite cam surface thereon converging to a low point, a latch bolt having stop means thereon and being pivotally mounted in the housing about a vertical axis and moveable from an extended to a retracted position, the latch bolt having follower means normally engaging the cam surfaces at the said low point whereat the latch bolt is extended, lever means pivotally mounted intermediate its ends in the housing on a horizontal pin, one end of the lever held captive in the slide, the other end extending out beyond the housing at an angle and adapted to be engaged by the panic bar, a blocking leg pivotally mounted in the housing on a vertical axis, the leg occasionally being in blocking position with respect to the stop means, and connecting means between the horizontal pin and the blocking leg so that the initial rotary movement of the horizontal pin upon depression of the panic bar moves the blocking leg so it does not block the retraction of the latch bolt.

2. An exit device as claimed in claim 1 wherein the device further includes an auxiliary bolt adapted to assume an extended or retracted position spaced from and pivoted about the same axis as the latch bolt, said blocking leg generally aligned with the auxiliary bolt and having its distal end biased toward and normally engaging the outer rim of the auxiliary bolt, the leg having an auxiliary-bolt-projection-engaging portion, the rim of the auxiliary bolt being cam-shaped and extending farther from its axis at its inner end than its outer end, whereby when the auxiliary bolt is extended, the leg engages the inner end of the auxiliary bolt and the projection-engaging portion clears the projecting, but when the auxiliary bolt is held retracted, the blocking leg engaging adjacent the outer end of the auxiliary bolt, is in a position with the projection-engaging portion blocking the stop means of the latch bolt.

3. An exit device as claimed in claim 2 wherein the blocking leg is U-shaped and the connecting means includes an irregularly shaped window in the bight, of the blocking leg, the horizontal pin also having an irregularly shaped end, also comprising part of the connecting means, the end butting into and cooperating with the window when the pin rotates as the panic bar moves, to drive the blocking leg to clear the retraction of the latch bolt.

4. An exit device as claimed in claim 1 wherein the blocking leg is U-shaped and the connecting means includes an irregularly shaped window in the bight of the blocking leg, the horizontal pin also having an irregularly shaped end also comprising part of the connecting means, the end butting into and cooperating with the window when the pin rotates as the panic bar moves, to drive the blocking leg to clear the retraction of the latch bolt.

5. An exit device as described in claim 1 wherein the upper and lower ends of the vertical slide are adapted to engage conventional upper and lower latch rods.

6. An exit device comprising a horizontal panic bar, adapted to be mounted waist-high on a swinging door, a latch housing adapted to be secured outward of the door adjacent an end of the panic bar, the latch housing holding a vertically reciprocable slide having an inclined cam surface, a latch bolt having stop means thereon and being pivotally mounted in the housing about a vertical axis and moveable from an extended to a retracted position, the latch bolt having follower means normally engaging the cam surface at the point whereat the latch bolt is extended, lever means pivotally mounted intermediate its ends in the housing on a horizontal pin, one end of lever connected to the slide, the other end extending out beyond the housing at an angle and adapted to be engaged by the panic bar, a blocking leg pivotally mounted in the housing on a vertical axis, the leg occasionally being in blocking position with respect to the stop means, and interfitting means on the horizontal pin and the blocking leg so that the initial rotary movement of the horizontal pin upon depression of the panic bar moves the blocking leg so it does not block the retraction of the latch bolt.

* * * * *